US005458235A

United States Patent [19]

Stone

[11] Patent Number: 5,458,235

[45] Date of Patent: Oct. 17, 1995

[54] GIFT PRODUCT

[75] Inventor: Irving I. Stone, Beachwood, Ohio

[73] Assignee: American Greetings Corporation, Cleveland, Ohio

[21] Appl. No.: 173,175

[22] Filed: Dec. 23, 1993

[51] Int. Cl.[6] ..... B65D 85/60

[52] U.S. Cl. ..... 206/232; 40/124.1; 40/313; 206/459.5; 426/87; 426/112

[58] Field of Search ..... 40/124.1, 312, 40/313; 206/45.31, 232, 459.5; 229/126; 426/87, 104, 108, 112, 124, 383

[56] References Cited

U.S. PATENT DOCUMENTS

| | | | |
|---|---|---|---|
| 1,128,052 | 2/1915 | Roy | 40/313 |
| 1,143,729 | 6/1915 | Schmidt | 40/312 |
| 1,576,029 | 3/1926 | Beakes | 426/87 |
| 2,488,121 | 11/1949 | Greve | 229/126 |
| 2,672,274 | 3/1954 | Crane | 206/45.31 |
| 2,743,862 | 5/1956 | Paige | 206/45.31 |
| 2,745,596 | 5/1956 | Lorenzsonn | 206/232 |
| 3,380,644 | 4/1968 | D'Alessio . | |
| 4,203,516 | 5/1980 | Stonga et al. | 426/87 |
| 4,433,780 | 2/1984 | Ellis . | |
| 4,733,863 | 3/1988 | Novotny | 426/87 |
| 5,038,930 | 8/1991 | Holtkamp, Jr. . | |
| 5,096,058 | 3/1992 | Juravin et al. . | |
| 5,232,087 | 8/1993 | Schluger . | |
| 5,289,917 | 3/1994 | Chabria | 206/232 |

FOREIGN PATENT DOCUMENTS

| | | | |
|---|---|---|---|
| 0004423 | of 1906 | United Kingdom | 206/45.31 |

OTHER PUBLICATIONS

"Chocolate Christmas Cards," *Christmas Gift Book,* The Swiss Colony, B34, 1982.

*Primary Examiner*—Jimmy G. Foster
*Attorney, Agent, or Firm*—Calfee, Halter & Griswold

[57] ABSTRACT

A gift product comprising a candy box with a plurality of individually wrapped pieces of candy, and a greeting card formed in one piece with the candy box. The greeting card comprises a front wall of the candy box and a greeting card panel formed in one piece with the front wall and moveable between a closed position in which the greeting card panel covers the front wall and an open position in which the greeting card panel uncovers the front wall. The greeting card panel has an outside surface which is visible to a person holding the gift product when the panel is in the closed position and an inside surface which is visible to a person holding the gift product when the panel is in the open position. The front wall of the candy box has a window through which the individually wrapped pieces of candy can be viewed when the panel is in the open position. The outside and inside surfaces of the greeting card panel, and the individual candy wrappers all have a common personal sentiment thereon, so that when the gift product is closed the common personal sentiment is conveyed by the outside surface of the panel, and when the gift product is opened, the common personal sentiment is conveyed by the inside surface of the panel and the candy wrappers which are visible through the window in the front wall of the candy box.

8 Claims, 3 Drawing Sheets

GIFT PRODUCT

FIELD OF THE INVENTION

The present invention relates to a gift product, and particularly to a gift product comprising a combination candy box and greeting card.

BACKGROUND

Gifts, such as candy boxes, are often accompanied by a card or note upon which the sender of the gift can write a personal message to the recipient. The card might be adhesively attached to the candy box, or might be secured to the candy box by the ribbon or cord which wraps the candy box. The card might also be inserted inside the candy box. In any event, it is well known to accompany a candy box with a separate card conveying a personal message from the sender to the recipient.

SUMMARY OF THE PRESENT INVENTION

The present invention provides a new type of gift product in which a greeting card is formed in one piece with a candy box, and a common personal sentiment is incorporated into (and conveyed by) the greeting card, the candy box, and the pieces of candy in the candy box.

Specifically, the gift product comprises a candy box with a plurality of individually wrapped pieces of candy, and a greeting card formed in one piece with the candy box. The greeting card comprises a front wall of the candy box and a panel formed in one piece with the candy box and pivotal between a closed position in which the panel covers the front wall of the candy box and an open position in which the panel uncovers the front wall of the candy box. The panel has an outside surface which is visible and conveys the common personal sentiment when the panel is in the closed position. The panel has an inside surface which is visible and is disposed in side by side relation with the front wall of the candy box when the panel is in its open position. The front wall of the candy box has a window through which individually wrapped pieces of candy can be viewed when the panel is in its open position. Each piece of candy has a wrapper with the common personal sentiment on the outside thereof, and the wrappers for a plurality of the individually wrapped pieces of candy have different versions of a common personal sentiment on the outsides of their respective wrappers. The inside surface of the panel has the common personal sentiment thereon, so that when the panel is in an open position the common personal sentiment on the inside surface of the panel and on the candy wrappers which are visible through the window are both visible to a person opening the gift product.

Thus, the entire gift product, i.e., the candy box, the greeting card, and the individually wrapped pieces of candy, convey the common personal sentiment of the gift product. The common personal sentiment is conveyed by the outside of the panel when the panel is in the closed position, and is conveyed by the inside of the panel and wrappers of the candy pieces which are visible through the window when the panel is in the open position. The common personal sentiment is further conveyed by the outsides of the candy wrappers when the candy pieces are removed from the candy box. The whole essence of the gift product of the present invention is to convey the common personal sentiment.

Preferably, the common personal sentiment is a romantic personal sentiments, particularly a love message.

Further, according to the preferred embodiment, different versions of the common personal sentiment may be provided on the inside and outside surfaces of the panel. Also, several versions of the common personal sentiment are found on the wrappers of candy pieces in the candy box, and those versions are visible through the window in the candy box when the panel is in the open position. Thus, when the panel is in the open position the different versions of the common personal sentiment are conveyed on the wrappers of the candy pieces that are visible through the window.

Still further, according to the preferred embodiment, the gift product is formed of a single blank made of cardboard-like box stock, and the panel is hinged with the candy box portion of the blank, so that the panel is formed in one piece with the candy box.

Further features of the present invention will be apparent from the detailed description and the accompanying drawings.

DETAILED DESCRIPTION OF THE PREFERRED EMBODIMENT

Figure 1:
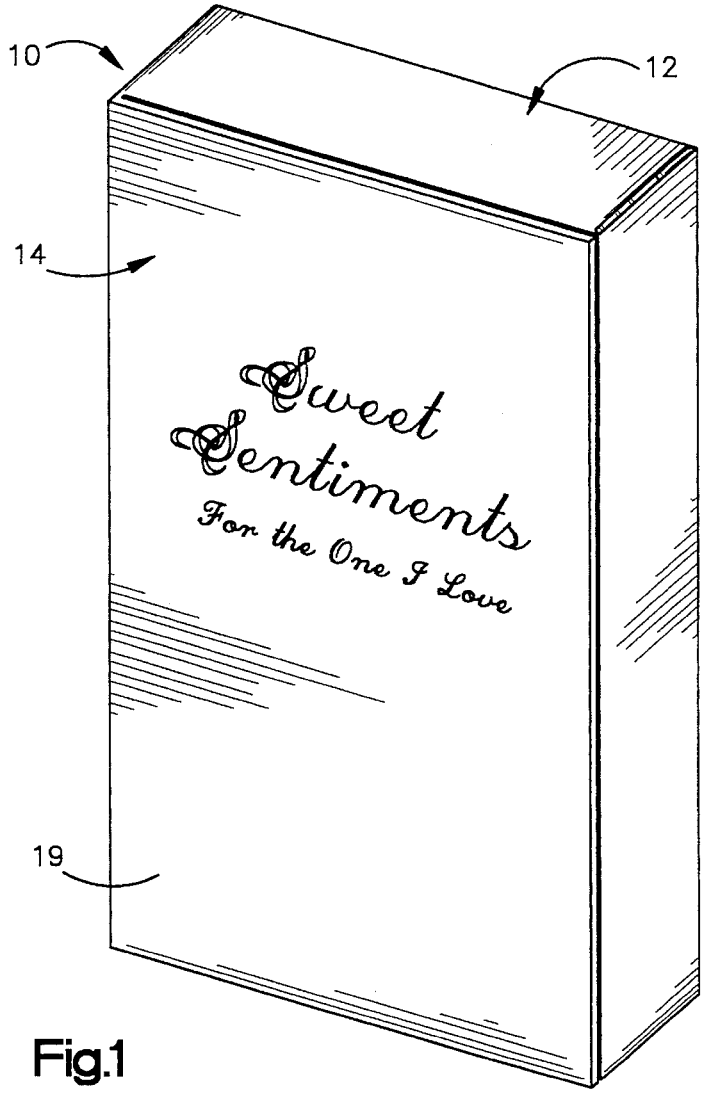
FIG. 1 is a perspective illustration of a gift product according to the present invention, in a closed position.
Figure 2:
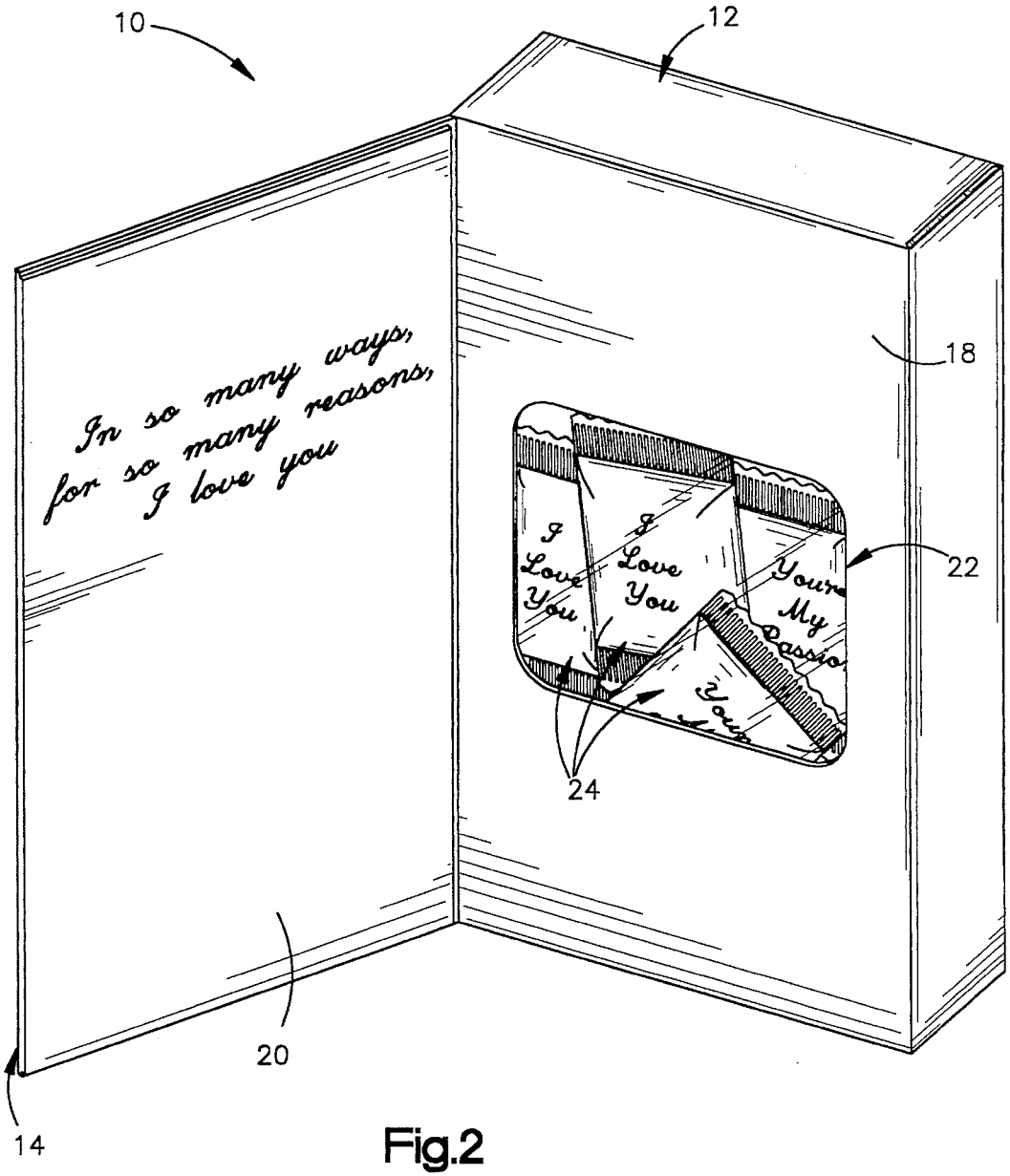
FIG. 2 is a perspective view a gift product according to the present invention in an open position.

As described above, the present invention relates to a gift product 10, which preferably comprises a candy box 12 with a plurality of individually wrapped pieces of candy, and a greeting card panel 14 formed in one piece with the candy box. The gift product 10 has a closed position, illustrated in FIG. 1, and an open position, illustrated in FIG. 2. In the closed position, the greeting card panel 14, which is formed in one piece with the candy box 12 covers a front wall 18 of the candy box 12. In the closed position, an outside surface 19 of the greeting card panel is visible to a person handling the gift product. The greeting card panel 14 can pivot to an open position (FIG. 2), so that the front wall 18 is uncovered, and both the front wall 18 and the inside surface 20 of the greeting card panel 14 are visible to a person handling the gift product. In the open position,, the greeting card panel 14 and the front wall 18 of the candy box effectively form a greeting card. As seen in FIG. 2, the front wall 18 of the candy box has a window 22 through which individually wrapped pieces of candy 24 on the inside of the candy box can be viewed by a person handling the gift product.

In the closed position of the gift product (FIG. 1), the greeting card panel 14 covers the front wall of the candy box 12, and the outside surface 19 of the greeting card panel 14 is visible to a person handling the gift product. That outside surface 19 preferably carries a personal sentiment thereon. As used herein, the concept of a "personal sentiment" means a message, feeling, expression, etc. that is typically conveyed from one person directly to another person. It is preferred that the personal sentiment is a romantic sentiment, and even more particularly, that the personal sentiment conveys a feeling of love. Reference herein to a "common personal sentiment" means a personal sentiment which has a common theme (e.g., one person loving another), but for which there may be different versions of text, graphics (or combinations thereof) which relate to that common theme.

Thus, in the illustrated example, the outside surface 19 of the greeting card panel 14 has thereon a personal romantic sentiment comprising the message, "For the one I love", to convey that romantic personal sentiment to the recipient of the gift product. In this application, the concept of a panel, candy box or candy wrapper having a personal sentiment "thereon" is intended to mean that the personal sentiment is applied to the panel, candy box or candy wrapper by printing, embossing, securing or some other means for affixing a graphical and/or textual image (in two or three dimensions) to the panel, candy box, or candy wrapper.

The inside surface 20 of the greeting card panel 14, which is visible when the gift product is in the open position, also conveys the common personal sentiment. Thus, in the disclosed example, the inside surface 20 carries the message, "In so many ways, for so many reasons—I love you", which also conveys the common romantic personal sentiment to the recipient of the gift product.

Figure 3:
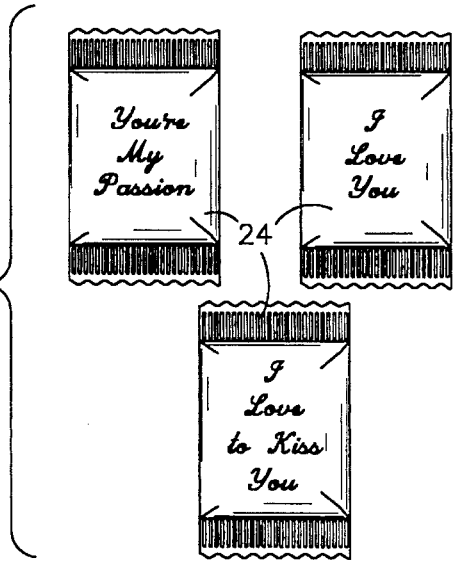
FIG. 3 is a schematic illustration of several individually wrapped candy pieces with different, personal sentiments thereon.

The individually wrapped pieces of candy 24 on the inside of the candy box 12 have individual wrappers, each of which has a personal sentiment thereon. FIG. 3 schematically illustrates three individually wrapped pieces of candy with personal romantic sentiments on the wrappers of the candy pieces. According to the preferred embodiment, the personal sentiments on the wrappers of the candy pieces are romantic sentiments such as, "I love you", "You're my passion", "I Love to kiss you", "Our love was meant to be", "You're my happiness", "Today tomorrow, always . . . love", "I love your sweet kisses", "Every day I love you more", "You're so lovable", "I love loving you", "You melt my heart", "I found love when I found you", If this is love, I love it!"You're my everything!", "XOXOXO Hugs and Kisses XOXOXO", and "You're my dream come true". Of course, it is contemplated that other personal romantic messages, which fit the common romantic sentiment of the inside and outside surfaces of the greeting card panel may be provided on the wrappers of the candy pieces.

The individually wrapped pieces of candy 24 are inserted through foldable covers at either ends of the candy box 12, and are disposed behind the window 22 in the front wall 18 of the candy box 12. The window 22 is covered by a clear plastic material so that the candy wrappers can be viewed through the window 22. When the gift product is closed, the front wall 18 of the candy box 12 (including the window 22) is covered, but the personal sentiment on the outside surface 19 of the greeting card panel 14 is visible to a person holding the gift product. When the gift product 10 is opened, the common personal sentiment on the inside surface 20 of the greeting card panel is visible to a personal holding the gift product and the personal sentiments on the candy wrappers 24 that are behind the window 22 are also visible and convey the common personal sentiment of the gift product. When a piece of candy is removed from the candy box 12, the wrapper on the piece of candy also conveys the common personal sentiment of the gift product. Thus, in essence, the entire gift product, i.e., every part of the gift product, conveys the common personal sentiment of the gift product.

Figure 4:
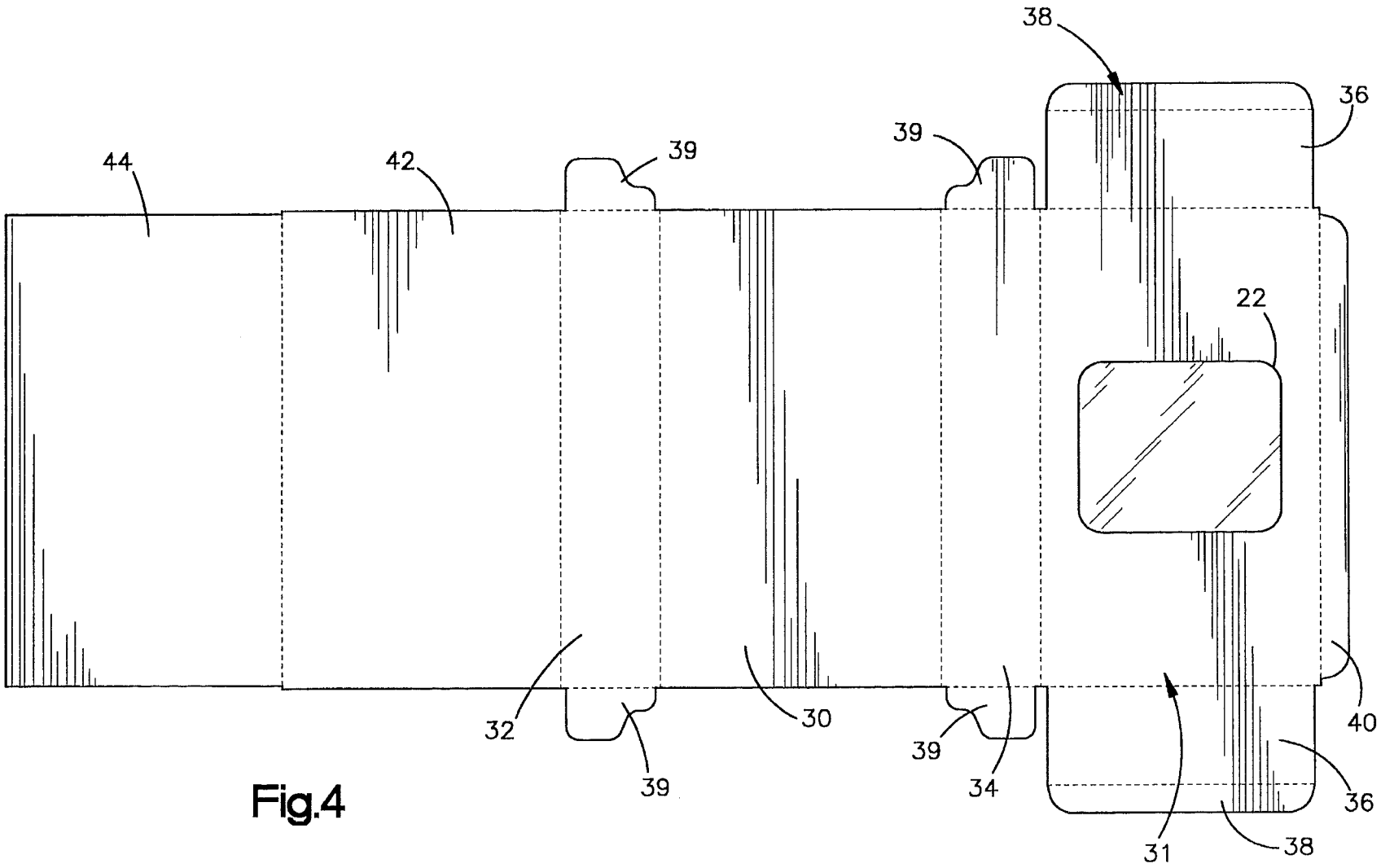
FIG. 4 is a blank for forming a gift product according to the present invention.

The gift product is preferably formed from a single blank made of cardboard-like box stock, which is schematically illustrated in FIG. 4. The blank comprises a pair of candy box main panels 30, 31, a pair of candy box side panels 32, 34, and pivotal closure flaps 36, 38 at opposite ends of the candy box main panel 31 to close the opposite ends of the candy box. Each candy box side panel has end closure flaps 39 pivotally secured thereto to help securely close the opposite ends of the candy box. An end flap 40 is secured to an edge of the candy box main panel 31. The end flap 40 is adapted to be adhesively secured to the candy box side panel 32 when the candy box is being formed. The candy box main panel 31 forms the front wall of the candy box, and has the window 22 formed therein. The greeting card panel comprises a panel 42 with an edge pivotally connected to the candy box side panel 32, and another edge pivotally connected to a panel 44. When the panel 44 is folded onto the panel 42 and the surface of panel 44 which is adjacent panel 42 is secured (e.g., by adhesive) to the panel 42, the other surface of the panel 44 forms the inside surface 18 of the greeting card panel 14.

The individually wrapped pieces of candy 24 have relatively thin candy wrappers, each with the common personal sentiment thereon. The individually wrapped pieces of candy can be removed from the candy box and the common personal sentiment on the candy wrappers will be visible to a person holding the pieces of candy.

Thus, according to the present invention, a gift product has been provided within which a common personal sentiment, such as a romantic love greeting pervades the entire gift product, both as to the card part of the product, the candy box part of the product, and the individually wrapped candy pieces forming part of the gift product. With the foregoing disclosure in mind, it is believed that various modifications of this product will be apparent to those of ordinary skill in the art.

I claim:

1. A gift product comprising a candy box having a plurality of individually wrapped pieces of candy and a greeting card formed in one piece with said candy box, said greeting card comprising a front wall of said candy box and a panel formed in one piece with said front wall and being pivotal between a closed position in which said panel covers said front wall and an open position in which said panel uncovers said front wall, said panel having an inside surface which is visible when said panel is in said open position, said front wall having a window smaller in area than said front wall through which individually wrapped pieces of candy can be viewed when said panel is in said open position, the wrappers of each piece of candy and said inside surface of said panel having a common personal sentiment thereon, so that when said panel is in said open position the common personal sentiment on said inside surface of said panel and on the candy wrappers which are visible through said window are visible to a person holding the gift product.

2. A gift product as defined in claim 1, wherein said panel having an outside surface which is visible when said panel is in said closed position, said outside surface having said common personal sentiment thereon.

3. A gift product as defined in claim 2, wherein the wrappers for a plurality of the individually wrapped pieces of candy having different versions of a common personal sentiment on the outside thereof, candy wrappers with said different versions of said common personal sentiment being disposed behind said window, so that said different versions are visible through said window when said greeting card panel is in said open position.

4. A gift product as set forth in claim 3, wherein the common personal sentiment comprises a romantic personal sentiment.

5. A gift product as set forth in claim 4, wherein said candy box and greeting card panel are components of a single blank of box stock.

6. A gift product as set forth in claim 1, wherein said window is covered by a clear plastic material so that said front panel including said clear plastic material closes the front of said candy box when said panel is in an open position.

7. A gift product as set forth in claim 6, wherein the wrappers of a plurality of the individually wrapped pieces of candy have different versions of said common personal sentiment on the outside thereof, said candy wrappers having said different versions of said common personal sentiment being disposed behind said window so that said different versions are visible through said window when said panel is in said open position.

8. A gift product as defined in claim 7, wherein said panel has an outside surface which is visible when said panel is in said closed position, said outside surface having said common personal sentiment thereon whereby all three major surfaces of said product being comprised by the outside surface of said panel, the inside surface of said panel and said front wall including said window thereof convey the same common personal sentiment.

* * * * *